United States Patent [19]

Ernst et al.

[11] Patent Number: 4,511,955

[45] Date of Patent: Apr. 16, 1985

[54] VEHICLE HEADLIGHT

[75] Inventors: Hans-Otto Ernst; Wilhelm Röhling, both of Lippstadt, Fed. Rep. of Germany

[73] Assignee: Westfälische Metall Industrie KG Hueck & Co., Lippstadt, Fed. Rep. of Germany

[21] Appl. No.: 494,761

[22] Filed: May 16, 1983

[30] Foreign Application Priority Data

May 18, 1982 [DE] Fed. Rep. of Germany ..... 3218702

[51] Int. Cl.[3] ..... F21M 3/08

[52] U.S. Cl. ..... 362/347; 362/268; 362/296; 362/328

[58] Field of Search ..... 362/61, 257, 268, 296, 362/311, 317, 341, 347, 350, 804, 355, 328

[56] References Cited

U.S. PATENT DOCUMENTS

| | | | |
|---|---|---|---|
| 1,480,364 | 1/1924 | Bean | 362/296 |
| 1,539,696 | 5/1925 | Ritchie | 362/257 |
| 1,598,044 | 8/1926 | Bone | 362/61 X |
| 1,898,166 | 2/1933 | Bean | 362/350 |
| 1,898,167 | 2/1933 | Bean | 362/350 |
| 3,492,474 | 1/1970 | Yamaguchi et al. | 362/350 |
| 3,922,073 | 11/1975 | Schwartz | 362/355 X |
| 4,149,227 | 4/1979 | Dorman | 362/804 X |
| 4,222,027 | 9/1980 | Mikkers | 362/351 X |
| 4,225,903 | 9/1980 | Buchleitner | 362/61 |

FOREIGN PATENT DOCUMENTS

| | | | |
|---|---|---|---|
| 0031211 | 7/1981 | European Pat. Off. | 362/61 |
| 0068428 | 1/1983 | European Pat. Off. | 362/350 |
| 2004565 | 8/1970 | Fed. Rep. of Germany | 362/347 |
| 2240307 | 2/1973 | Fed. Rep. of Germany | 362/347 |
| 2446521 | 4/1975 | Fed. Rep. of Germany | 362/268 |
| 2459938 | 2/1981 | France | 362/350 |
| 173243 | 12/1921 | United Kingdom | 362/268 |
| 1023894 | 3/1966 | United Kingdom | 362/804 |
| 1074458 | 7/1967 | United Kingdom | 362/347 |
| 2059566 | 4/1981 | United Kingdom | 362/347 |

*Primary Examiner*—David H. Brown
*Assistant Examiner*—John E. Griffiths
*Attorney, Agent, or Firm*—Horst M. Kasper

[57] ABSTRACT

A vehicle headlight for providing a shaped beam spreading as a flat bundle. A dish-shaped reflector is employed where the inner reflection surface in the axial longitudinal sections in each case forms an ellipse segment, where the ellipse eccentricity increases from the longitudinal section spanned by the vertical and the reflector axis to the longitudinal section spanned by the horizontal and the reflector axis, where the focal points of the ellipse segments of all sections disposed in planes containing the reflector axis coincide, and where the vertices of the ellipse segments of all sections disposed in planes containing the reflector axis coincide. The depth of the reflector within the longitudinal sections of the reflector containing the reflector axis corresponds to the longer half-axis of the respective ellipse.

18 Claims, 3 Drawing Figures

VEHICLE HEADLIGHT

BACKGROUND OF THE INVENTION

1. Field of the Invention

The present invention relates to a vehicle headlight with a dish-shaped reflector, where the inner reflection surface has in its sections containing the dish-axis in each case an ellipse segment, where the eccentricity of the ellipse increases when going from the vertical axial section to the horizontal axial section.

2. Brief Description of the Background of the Invention Including Prior Art

Dish-shaped reflectors where sections containing the dish axis show ellipse segments for the inner curve of the reflector surface section are employed in headlights, which operate according to the projector principle. Such a headlight is described in German Patent Application Laid Open DE-OS No. 2,446,521.

A reflector is employed where the reflection surface in a vertical axial section represents an ellipse segment, where the inner focal point is designated as F and where the diaphragm designated as a screen is disposed at its outer focal point. The outer focal point of this ellipse segment forms at the same time the focal plane of the lens body disposed in front of the reflector. The reflection surface shows in the horizontal axial section a different form, which can among other shapes also be provided as elliptical. The description teaches about this only that this other shape or also elliptical shape is provided such that the light reflected by the reflector is scattered more in the horizontal directions as compared to the vertical directions. FIG. 3 of DE-OS No. 2,446,521 indicates that the ellipse running in a horizontal longitudinal section through the reflector is disposed such that its longer axis a' is vertical on the axis a in the horizontal axial section through the reflector. An ellipse segment with two focal points results from the horizontal axial section, which focal points are disposed on the front straight delineating line of this ellipse segment. The sections through the reflector between the horizontal axial section and the vertical axial section are to be provided such that the reflector as seen from the front again provides an ellipse according to FIG. 2, and that all sections, which are parallel to the section, as shown in FIG. 2, again result in ellipses.

The light is in fact strongly bundled in the vertical direction of such a headlight and is scattered more in horizontal direction, however the scattering in horizontal direction is uncontrolled and very heavy, since the incandescent filament is disposed between the two focal points of the ellipse resulting in the horizontal axial section.

It is a further disadvantage of conventional reflectors that the outer front edge of the reflecting dish runs in a plane. This means that the largest possible reflection surface is not exploited without that in the main output direction, which is at the same time the removal direction from the mold tool of the reflector produced by injection molding or casting, an undercutting or back taper results.

SUMMARY OF THE INVENTION

1. Purposes of the Invention

It is an object of the present invention to provide a headlight, which bundles the emitted light strongly in the vertical direction as taught in in DE-OS No. 2,446,521, where however also the light reflected from the side regions of the reflector is concentrated such that it is collected by a convex lens of relatively small size and disposed at a distance from the reflector.

It is another object of the present invention to assure that not all the light reflected by the reflector impinges the convex lens in a point image.

It is a further object of the present invention to provide a headlight where the reflector in a controlled way spreads the light beam less in vertical direction as compared to the horizontal direction.

These and other objects and advantages of the present invention will become evident from the description which follows.

2. Brief Description of the Invention

The present invention provides a vehicle headlight for furnishing a shaped light beam which comprises a dish-shaped reflector where the inner reflection surface along a section passing through the reflection axis in each case forms an ellipse segment, where the ellipse eccentricity increases from the longitudinal section spanned by the vertical and the reflector axis to the longitudinal section spanned by the horizontal and the reflector axis, where the focal points of the ellipse segments of all sections disposed in planes containing the reflector axis coincide, and where the vertices of the ellipse segments of all sections disposed in planes containing the reflector axis coincide.

The depth of the reflector within the longitudinal sections of the reflector containing the reflector axis can correspond to the full length of the longer half-axis of the respective ellipse. The reflector can be produced by injection molding, by pressing and/or by casting. The reflector can be provided with an attachment flange radially extending outwardly and formed to an outer contour of the reflector.

A recessed edge can be attached to the outer edge of the reflector variable in its height and provided for supporting an attachment means. Preferably, the attachment means is a flange formed to adapt to the recessed edge.

The eccentricity e of the ellipse segment disposed in a longitudinal section plane containing the vertical can be from about 0.6 to 0.75. The eccentricity of the ellipse segment disposed in a longitudinal section plane containing the horizontal can be from about 0.65 to 0.8. The ratio of the eccentricity of the ellipse segment in a horizontal plane containing the reflector axis to the eccentricity of the ellipse segment in a vertical plane containing the reflector axis can be from about 1.05 to 1.20.

A convex lens can be disposed about the focal point of the light beam deflected about within a horizontal axis plane by the deflector. The size of the lens can be adapted to collect light coming from the focal point of light reflected by the reflector within about a vertical plane. A diaphragm can be disposed about the focal point of light reflected by the reflector within about a vertical plane and can have a substantially horizontally running edge for producing a bright-dark delineation.

There is further provided a method for producing a shaped light beam for a vehicle headlight which comprises providing a reflector where the vertical plane passing through the reflector axis contains an ellipse segment and where the horizontal plane passing through the reflector axis contains an ellipse segment as inner surface line of the reflector and where the ellipse segment about within the horizontal plane has a larger eccentricity as compared to the ellipse segment about within a vertical plane, placing a light source at the coinciding focal point of the ellipse segments disposed close to the reflector, imaging the light reflected within about the vertical plane to an area where a diaphragm is disposed, and imaging the light reflected within about a horizontal plane to a further remote spaced area, where a convex lens is disposed.

The diaphragm disposed about the focal point of the light beam deflected within about a vertical plane can generate a bright-dark delineation. An attachment flange can be mounted to a recessed edge of the reflector outside. The light coming from the light source can be focussed into a bundle substantially running in a horizontal plane, which beam extends over a wider open area as compared with a beam coming from the light source and substantially running in a vertical plane.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which is shown one of the various possible embodiments of the present invention.

DESCRIPTION OF INVENTION AND PREFERRED EMBODIMENTS

Figure 1:
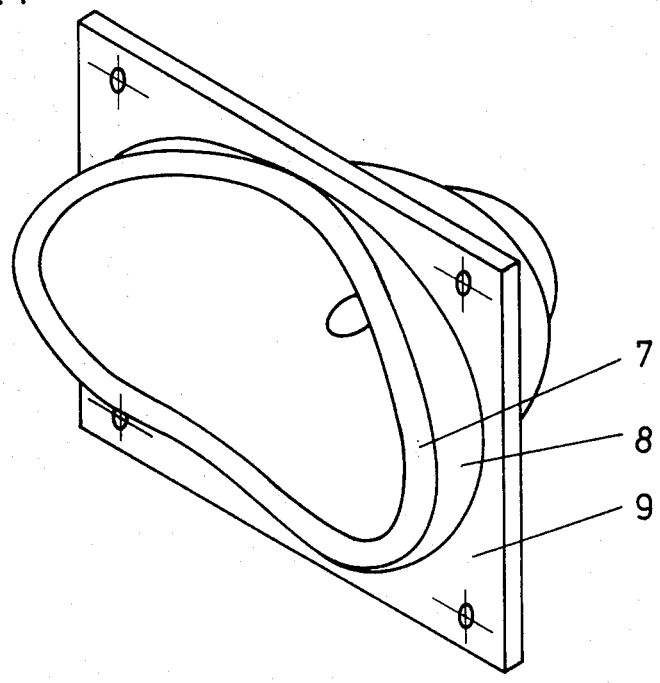
FIG. 1 is a perspective view of the reflector and back part of a headlight.

In accordance with the present invention there is provided a vehicle headlight with a dish-shaped reflector, where the inner reflection surface in an axial longitudinal section in each case forms an ellipse segment, the eccentricity of which increases from the vertical axial longitudinal section to the horizontal axial longitudinal section, which is characterized in that the focal points 5 of the ellipse segments 1, 2 of all axial sections as well as their corresponding vertices 4 of the ellipse segments 1, 2 coincide.

The depth of the reflector in the axial longitudinal sections of the reflector 3 can correspond to the full length of the longer half axis a of the ellipse in each case. The reflector can be produced by injection molding or by a pressing method. The reflector 3 can be provided with an attachment flange radially extending outwardly and adapted to the outer contour of the reflector. A recessed edge 8 can be formed at the outer edge 7 of the reflector 3 changing in height level, which recessed edge supports the attachment means 9. The attachment flange 9 can be formed to the recessed edge 8.

The focal points of the ellipse segments of all axial sections as well as their corresponding vertices of the ellipse segments coincide in each case. This ensures that the image of the upper diaphragm edge is sharp, that a relatively large width spreading of the light is achieved, that a lens of small dimension can be employed and that a focal line results, which is disposed on the middle axis of the outer focal point of the ellipse segment resulting from the vertical axial section and the outer focal point resulting from the horizontal axial section. The latter ensures that the convex collector lens is not heated up excessively.

In order to maximize the reflected light output from the reflector and to increase the solid angle at which the reflector surrounds the light source and to increase simultaneously the part of the light exiting from the light source and being reflected by the reflector, the present invention provides further that the reflector depth in the axial longitudinal sections of the reflector corresponds to the full length of the longer half-axis of the respective ellipse in each case.

The outer edge of the reflector according to the present invention runs at different height levels and is thus not any longer suited as a location for the attachment means of the reflector. The present invention provides in this respect that a recessed edge is formed into the outer edge, which carries the attachment means. This provides the possibility that the attachment means, if required, are disposed within one plane. According to a further feature of the invention these attachment means can be provided as radially cracking-off attachment flange.

Figure 3:
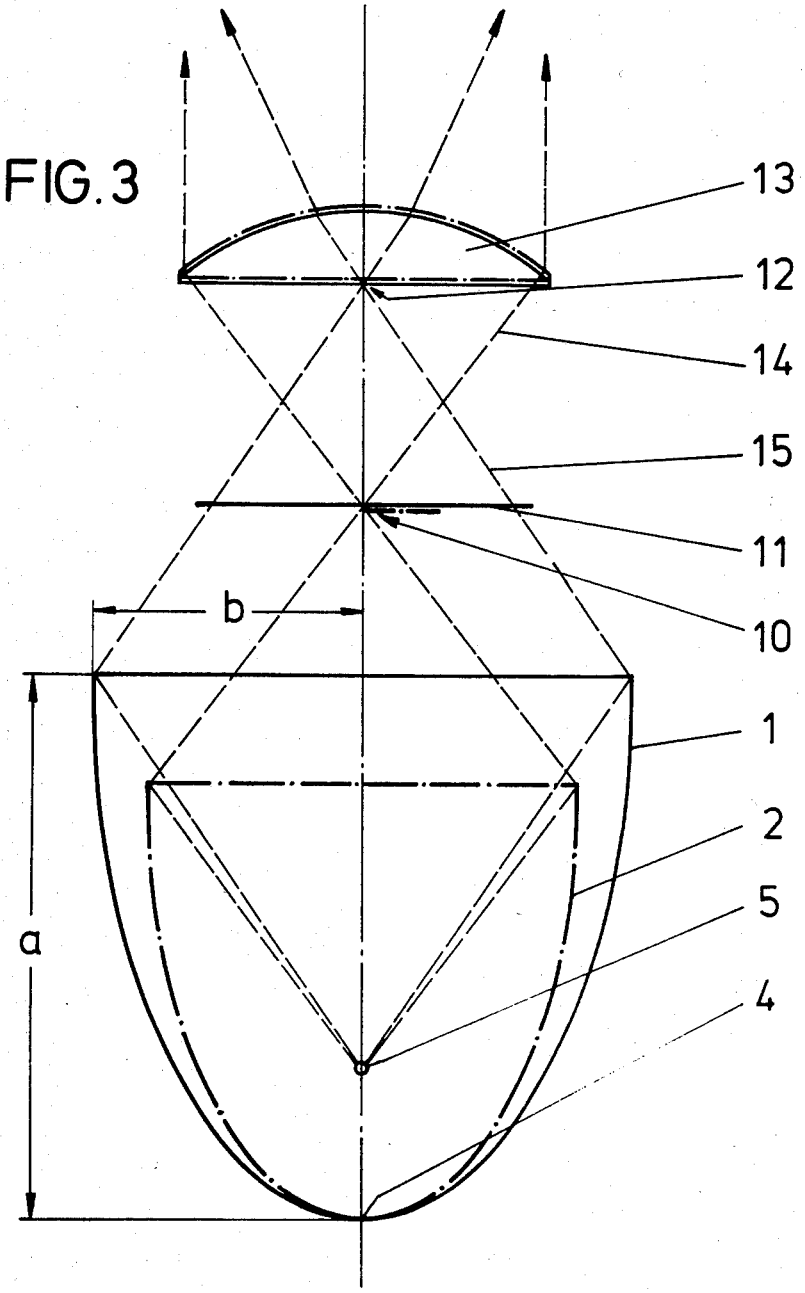
FIG. 3 is a schematic view through a horizontal axial longitudinal section through the headlight system, where the vertical longitudinal section is represented with dash-dotted lines.

The half-ellipse 1 in FIG. 3 represents the course of the curve of the reflector 3 in a horizontal, middle longitudinal section, while the half-ellipse 2 represents the course of the curve of the reflector 3 in a vertical middle longitudinal section. In this context it becomes clear that the two ellipses 1 and 2 are provided with the same vertex point 4 and with the same focal point 5 and are distinguished only by their eccentricity e.

The eccentricity is defined by the following formula:

$$e = (1/a)\sqrt{a^2 - b^2}$$

Here a is the length of the longer half-axis and b is the length of the shorter half axis.

Each axial longitudinal section through the reflector 3 results in a half-ellipse for the reflection surface 6. The eccentricity e of these half-ellipses becomes larger going from the vertical axial longitudinal section to the horizontal axial longitudinal section such that the reflector as seen from the front again provides about an ellipse. The reflector depth becomes larger from the vertical axial longitudinal section to the horizontal axial longitudinal section. The outer edge 7 of the reflector here takes such a contour shape that each axial longitudinal section represents a half-ellipse with the full half-axes a and b. Therefore a reflector 3 results in providing the largest possible part in reflected light without having the reflector 3 exhibit an undercutting or back taper when viewed in the main light output direction. The latter is important since such reflectors are manufactured economically only in mass production by way of injection molding or pressure casting and since the manufacturing tools in case of molds without undercutting are particularly favorable in their construction and their stability.

Figure 2:
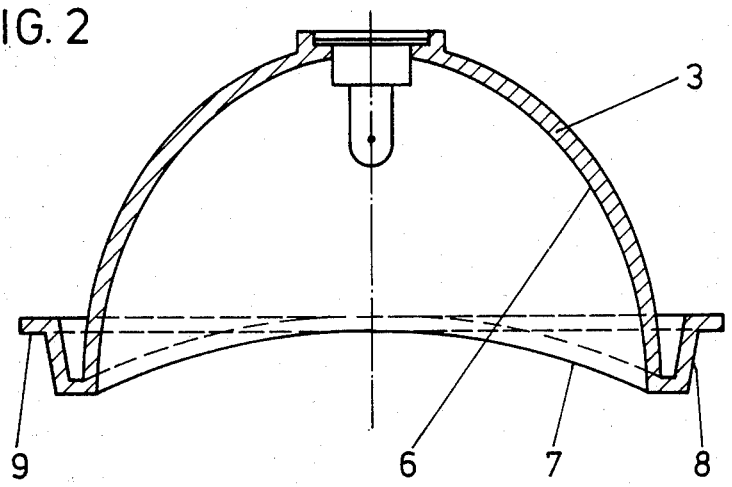
FIG. 2 is a view of a horizontal axial section through the reflector.

The outer edge 7 of the reflector passes into a recessed outer edge 8, which is provided with a radially outwardly protruding attachment edge 9 as shown in FIGS. 1 and 2, where corresponding parts are designated with the same numerals. This feature results in the advantage that the attachment means such as in the present case the attachment flange can be provided as plane surface materials even in case of a curved running outer edge of the reflector without requiring it to be formed to the outer wall of the reflector provided with the reflection surface 6. The latter would result in material accumulations and thus sink marks would occur. The sink marks would be detrimental to the quality of the reflection surface.

The mode of operation of the headlight is represented in FIG. 3. A diaphragm 11 is disposed at the outer focal point 10 of the ellipse 2 resulting in case of a vertical axial section, and the substantially horizontally running edge of the diaphragm 11 generates the bright-dark delineation. The planar surface of the lens 13 is disposed at the outer focal point 12 of the ellipse 1 resulting from a horizontal axial section, and the focal plane of the lens 13 is disposed in the focal point 10 of the ellipse 2. This provides that the light beam rays 14 exiting from the vertical middle section of the reflector 3 are bundled about to run in parallel, while the light beam rays 15 exiting from the horizontal axial section of the reflector 3 are in fact bundled, but are exiting nevertheless as a diverging beam. This results in a flat, however wide spread light band of the headlight.

It will be understood that each of the elements described above, or two or more together, may also find a useful application in other types of illumination system configurations and light bundling procedures differing from the types described above.

While the invention has been illustrated and described as embodied in the context of a vehicle headlight, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A vehicle headlight for providing a shaped beam comprising a dish-shaped reflector having an axis where an inner reflection surface in a section containing the axis of the reflector in each case forms an ellipse segment;

where the ellipse eccentricity increases from the longitudinal section spanned by the vertical and the reflector axis to the longitudinal section spanned by the horizontal and the reflector axis;

where the focal points of the ellipse segments of all sections disposed in planes containing the reflector axis coincide; and where the vertices of the ellipse segments of all sections disposed in planes containing the ellipse axis coincide.

2. The vehicle headlight for providing a shaped light beam according to claim 1 wherein the depth of the reflector within the longitudinal sections of the reflector containing the reflector axis correspond to the full length of a longer half-axis of the respective ellipse.

3. The vehicle headlight for providing a shaped light beam according to claim 1 wherein the eccentricity e of the ellipse segment disposed in a longitudinal section plane containing the vertical is from about 0.6 to 0.75.

4. The vehicle headlight for providing a shaped light beam according to claim 1 wherein the eccentricity e of the ellipse segment disposed in a longitudinal section plane containing the horizontal is from about 0.65 to 0.8.

5. The vehicle headlight for providing a shaped light beam according to claim 1 wherein the ratio of the eccentricity of the ellipse segment in a horizontal plane containing the axis to the eccentricity of the ellipse segment in a vertical plane containing the axis is from about 1.05 to 1.20.

6. The vehicle headlight for providing a shaped light beam according to claim 1 wherein the reflector is produced by an injection molding method.

7. The vehicle headlight for providing a shaped light beam according to claim 6 wherein the reflector further comprises an attachment flange radially extending outwardly and formed to an outer contour of the reflector.

8. The vehicle headlight for providing a shaped light beam according to claim 1 wherein the reflector is produced by a pressing method.

9. The vehicle headlight for providing a shaped light beam according to claim 8 wherein the reflector further comprises an attachment flange radially extending outwardly and formed to an outer contour of the reflector.

10. The vehicle headlight for providing a shaped light beam according to claim 1 wherein the reflector further comprises attachment means; and a recessed edge having a non uniform height, attached to the outer edge of the reflector and provided for supporting the attachment means.

11. The vehicle headlight for providing a shaped light beam according to claim 10 wherein the attachment means is a flange formed to the recessed edge.

12. A vehicle headlight for providing a shaped light beam comprising a dish-shaped reflector having an axis where an inner reflection surface in a section containing the axis of the reflector in each case forms an ellipse segment;

where the ellipse eccentricity increases from the longitudinal section spanned by the vertical and the reflector axis to the longitudinal section spanned by the horizontal and the reflector axis;

where the focal points of the ellipse segments of all sections disposed in planes containing the reflector axis coincide; and where the vertices of the ellipse segments of all sections disposed in planes containing the ellipse axis coincide; and a convex lens disposed about the focal point of the light beam deflected about within a horizontal plane by the reflector.

13. The vehicle headlight for providing a shaped light beam according to claim 12 wherein the size of the lens is adapted to collect light coming from the focal point of light reflected by the reflector within about a vertical plane.

14. A vehicle headlight for providing a shaped light beam comprising a dish-shaped reflector having an axis where an inner reflection surface in a section containing the axis of the reflector in each case forms an ellipse segment;

where the ellipse eccentricity increases from the longitudinal section spanned by the vertical and the reflector axis to the longitudinal section spanned by the horizontal and the reflector axis;

where the focal points of the ellipse segments of all sections disposed in planes containing the reflector axis coincide; and where the vertices of the ellipse segments of all sections disposed in planes containing the ellipse axis coincide; and a diaphragm disposed about at the focal point of light reflected by the reflector within about a vertical plane and having a substantially horizontally running edge for producing a bright-dark delineation.

15. A method for producing a shaped light beam for a vehicle headlight comprising providing a reflector where the vertical plane passing through a reflector axis contains an ellipse segment and where the horizontal plane passing through the reflector axis contains an ellipse segment as inner surface line of the reflector and where the focal points of the ellipse segments of all sections disposed in planes containing the reflector axis coincide and where the vertices of the ellipse segments of all sections disposed in planes containing the ellipse axis coincide and where the ellipse segment about within the horizontal plane has a larger eccentricity as compared to the ellipse segment about within a vertical plane;

placing a light source at the coinciding focal point of the ellipse segments disposed close to the reflector;

imaging the light reflected within about the vertical plane to an area where a diaphragm is disposed; and imaging the light reflected within about the horizontal plane to a further spaced area where a convex lens is disposed.

16. The method for producing a shaped light beam for a vehicle headlight according to claim 15 wherein the first imaging step includes generating a bright-dark delineation with the diaphragm disposed about the focal point of the light beam deflected within about a vertical plane.

17. The method for producing a shaped light beam for a vehicle headlight according to claim 15 wherein the providing step includes mounting an attachment flange to a recessed edge of the reflector outside.

18. The method for producing a shaped light beam for a vehicle headlight according to claim 15 wherein the second imaging step includes focussing the light coming from the light source into a bundle substantially running in a horizontal plane, which beam extends over a wider open area as compared with a beam coming from the light source and substantially running in a vertical plane.

* * * * *